United States Patent [19]

Bick et al.

[11] Patent Number: 4,535,872

[45] Date of Patent: Aug. 20, 1985

[54] RETARDERS SUITABLE FOR WAGON SPEED CONTROL AND HAVING MEANS FOR HOLDING THEM IN THEIR OPERATIVE CONDITION

[75] Inventors: David E. Bick, Newent; Christopher F. Flippance; Ian C. Parry, both of Cheltenham, all of England

[73] Assignee: Dowty Hydraulic Units Limited, England

[21] Appl. No.: 420,889

[22] Filed: Sep. 21, 1982

[30] Foreign Application Priority Data

Oct. 6, 1981 [GB] United Kingdom ..... 8130165

[51] Int. Cl.[3] ..... B61K 7/02

[52] U.S. Cl. ..... 188/62; 104/26 A

[58] Field of Search ..... 188/62, 32, 63, 265, 188/67, 271, 38.5, 300; 104/26 A, 162; 267/8 R, 8 B

[56] References Cited

U.S. PATENT DOCUMENTS

| | | | |
|---|---|---|---|
| 3,040,676 | 6/1962 | Checkley et al. | 188/62 |
| 3,148,633 | 9/1964 | Bick et al. | 104/162 |
| 3,637,052 | 1/1972 | Bick | 188/62 |
| 3,737,010 | 6/1973 | Nelson et al. | 188/32 |
| 4,015,862 | 4/1977 | Bahrman et al. | 188/300 X |
| 4,155,433 | 5/1979 | Porter | 188/300 |

FOREIGN PATENT DOCUMENTS

| | | | |
|---|---|---|---|
| 2507337 | 9/1976 | Fed. Rep. of Germany | 104/162 |
| 741217 | 11/1955 | United Kingdom . | |
| 744573 | 2/1956 | United Kingdom . | |
| 881189 | 11/1961 | United Kingdom . | |
| 1045919 | 10/1966 | United Kingdom . | |
| 2043316 | 10/1980 | United Kingdom . | |

*Primary Examiner*—Douglas C. Butler

*Attorney, Agent, or Firm*—Hayes, Davis & Soloway

[57] ABSTRACT

A retarder, suitable for reducing the speed of a wagon rolling along a railway track, includes a retainer, which is adapted to be secured upon or adjacent a rail of the track, and an hydraulic unit which is fitted in the retainer. A portion of the unit normally projects from the retainer thus to lie in the path of a wheel of the wagon so as to be engageable by that wheel. The portion is movable inwardly of the retainer to a position, out of the path, in which it permits the wheel to pass the retarder. The retarder includes holding mechanism for maintaining the portion in that position.

15 Claims, 5 Drawing Figures

Figure 1:
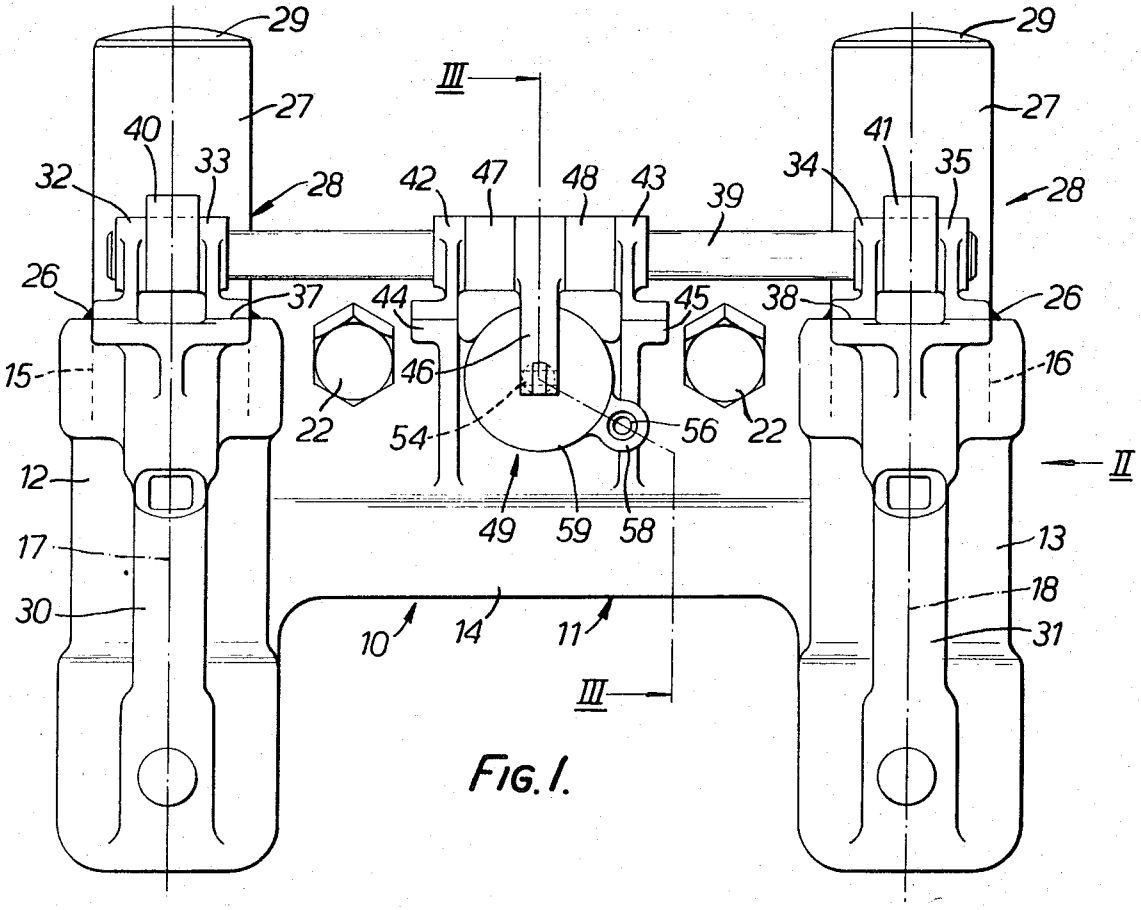

RETARDERS SUITABLE FOR WAGON SPEED CONTROL AND HAVING MEANS FOR HOLDING THEM IN THEIR OPERATIVE CONDITION

This invention relates to retarders of the kind suitable for reducing the speed of a wagon in which the movement of a wheel of the wagon, for example along a rail, is opposed by an hydraulic device acting against the periphery of the wheel.

Hitherto certain of such retarders have comprised a retainer, securable to a rail of a railway track, and an hydraulic unit removably inserted in the retainer, a portion of the unit being deflectable in a generally vertical direction by the periphery of a wheel rolling along the rail. Such a retarder is the subject of U.S. Pat. No. 3,637,052 and has particular application in railway marshalling yards, for example for use in retarding wagons being shunted into sidings.

However, when hitherto a cut of connected wagons has been moved by a locomotive or other traction means out from a siding equipped with such retarders, the wheels of all the wagons have engaged all the retarders, momentarily and successively deflecting the said portions of the hydraulic units of all of them. The consequential rapid reciprocation of those portions has resulted in the generation of considerable noise which has been undesirable environmentally, particularly where the marshalling yards are sited in or near highly populated areas.

The invention as claimed is intended to provide a remedy. It solves the problem of how to design retarders in which the generation of such noise can be avoided when wagons are so moved out from a siding.

According to this invention a retarder, suitable for reducing the speed of a wagon rolling along a railway track, includes a retainer which is adapted to be secured upon or adjacent a rail of said track, an hydraulic unit which is so fitted in said retainer that a portion thereof, which normally projects from the retainer thus to lie in the path of a wheel of said wagon so as to be engageable by that wheel, is movable inwardly of said retainer to a position out of said path in which it permits said wheel to pass said retarder, and holding means for maintaining said portion in that position.

The said portion of the hydraulic unit may be so movable inwardly of said retainer by said wheel as in rolling along said rail it engages said portion and may, alternatively, be so movable inwardly by actuator means mechanically engageable with said portion.

The holding means may be mounted on said retainer and may include a lever mechanism, part of which is caused mechanically to engage said portion of said hydraulic unit for holding it in said position.

The holding means may further include fluid-pressure-operable piston-and-cylinder means which is connected to another part of said lever mechanism.

The holding means may be operable pneumatically, hydraulically or electrically.

The retainer may be of elongate form, said retarder then including at least two of said hydraulic units which are fitted in parallel manner in the retainer. In this case said holding means is preferably adapted to be common to both or all of said hydraulic units so that in operation of the retarder simultaneous or substantially simultaneous holding of said portions of both or all of those units in said position can be caused to occur.

Also according to the invention there is provided a retarder, suitable for reducing the speed of a wagon rolling along a railway track, including an elongate retainer, which is adapted to be secured upon or adjacent a rail of said track, and at least two hydraulic units which are so fitted in said retainer that a portion of each unit, which normally projects from the retainer thus to lie in the path of a wheel of said wagon so as to be engageable by that wheel, is movable inwardly of said retainer to a position out of said path in which it permits passage of said wheel along said rail.

Both or all of said portions of said hydraulic units, when so moved inwardly of said elongate retainer, may be held in said position by holding means mounted on said retainer.

The said portions of said hydraulic units may be so movable inwardly of said retainer by said wheel as in rolling along said rail it engages said portions and may, alternatively, be so movable inwardly by actuator means mechanically engageable therewith.

The holding means may include a lever mechanism parts of which are caused mechanically to engage respective said portions of said hydraulic units for holding them in said position.

The holding means may further include fluid-pressure-operable piston-and-cylinder means connected to another part or parts of said lever mechanism. The holding means may be operable pneumatically, hydraulically or electrically and may be common to both or all said portions, or, alternatively, each of said portions may have its own said holding means.

The said actuator means may be operable pneumatically, hydraulically or electrically. Where two or more of said hydraulic units are provided said actuator means may be common to both or all said portions of said units of the retarder or, alternatively, each of said portions may have its own said actuator means.

The advantages offered by the invention are mainly that since in practice holding of said portion or portions inwardly of the retainer by said holding means occurs as the first wheel in a cut of connected wagons passes over a respective retarder, the remaining wheels in the cut subsequently passing over that retarder effect no inward displacement or only relatively small inward displacement of said portion or portions and thus a significant noise reduction in operation is achieved over retarders not so provided with said holding means.

Figure 2:
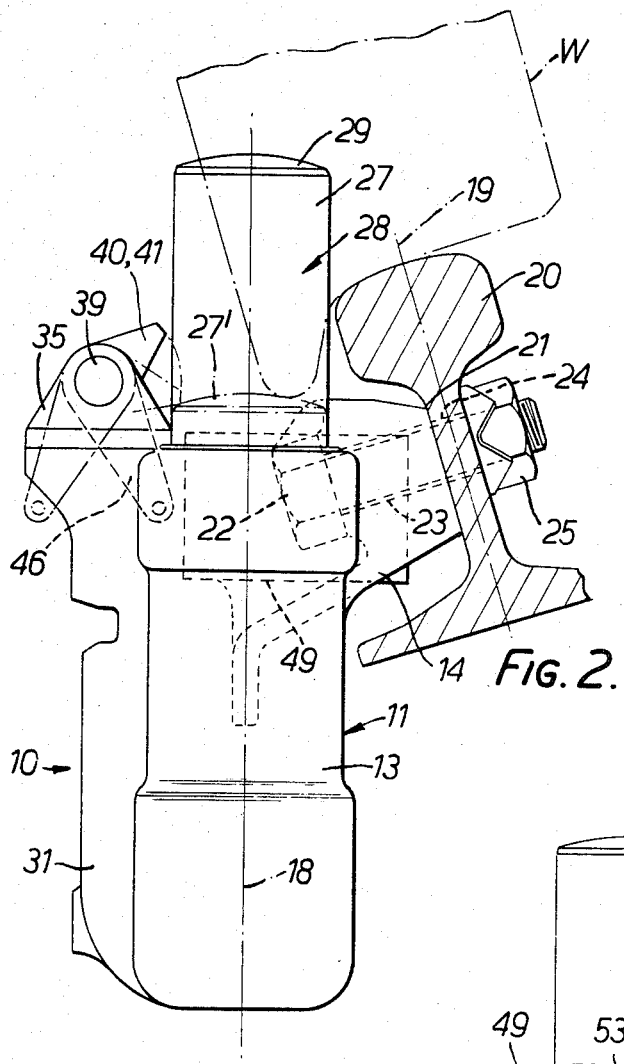
Figure 3:
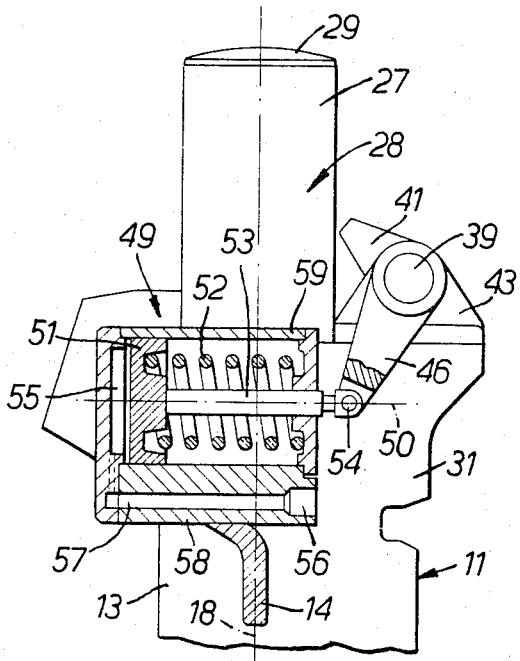
Figure 4:
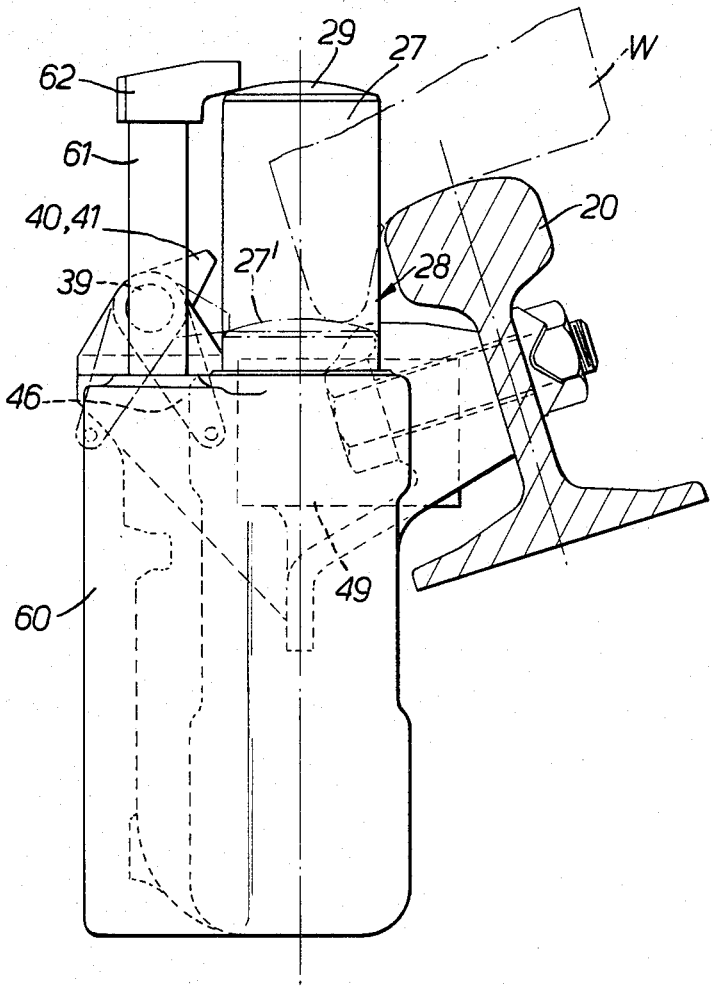
Figure 5:
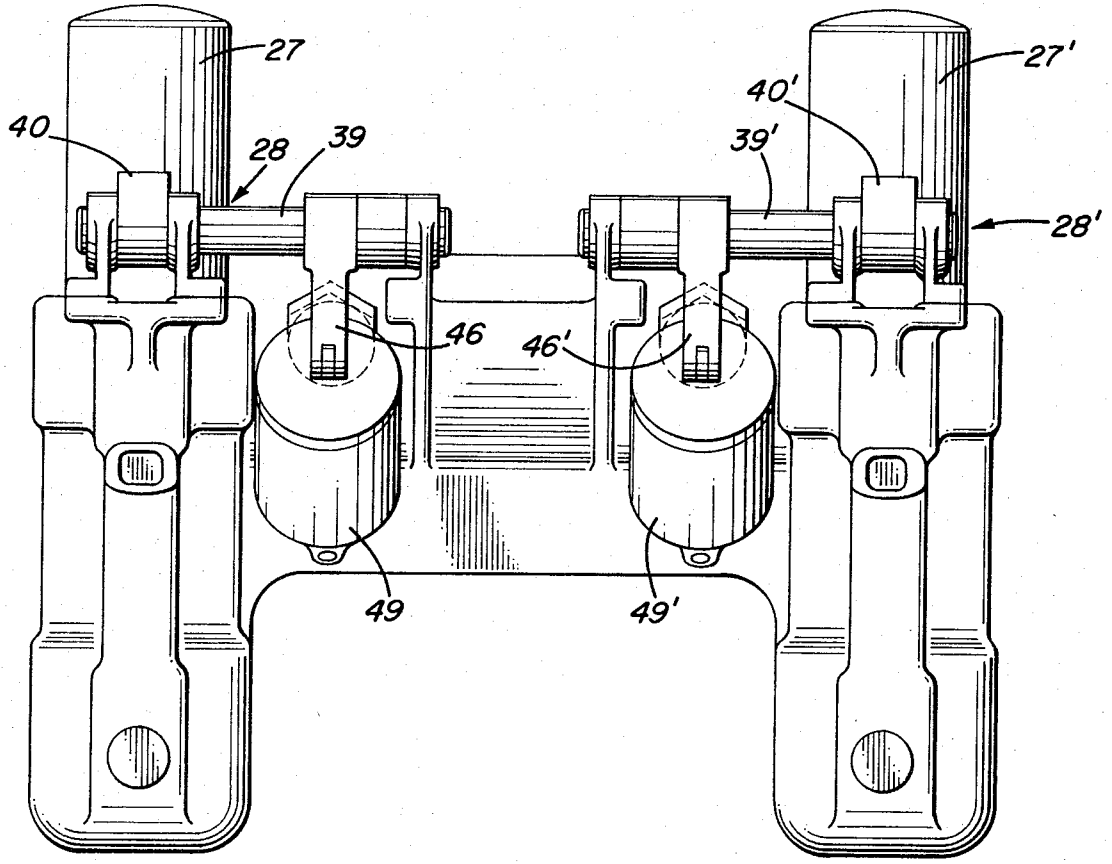

Two ways of carrying out the invention are described in detail below with reference to drawings which illustrate two specific embodiments, in which:

FIG. 1 is a side elevation of a retarder in accordance with the first embodiment which includes two hydraulic units, FIG. 2 is a view taken in the direction of the arrow II in FIG. 1, FIG. 3 is a cross-section taken along the line III—III in FIG. 1, FIG. 4 is a cross-section similar to that of FIG. 2 but in accordance with the second embodiment, FIG. 5 is a side elevation of a retarder similar to that of FIG. 1 modified to have separate holding means for each hydraulic unit.

FIGS. 1 to 3 show a multiple retarder 10 comprising an elongate retainer 11 which is formed in one piece and which comprises two end portions 12, 13 with intermediate portion 14, of the cross-sectional shape shown in FIG. 2, extending between them. Portions 12, 13 each have a respective bore, partly shown in dotted detail at 15, 16 in FIG. 1, which is open at its upper end, which is of circular cross-section and which is blind at its lower end. The axes 17, 18 of these bores are parallel and are somewhat inclined as shown in FIG. 2 to the vertical plane 19 of a rail 20 of a railway track.

The retarder is firmly secured to the inner side face 21 of this rail by two bolts 22. Each bolt passes through holes 23, 24 respectively formed in portion 14 and rail 20, and a nut 25 is applied to each bolt.

The bores 15, 16 which are of uniform diameter are each provided with a scraper ring 26 disposed at the upper end thereof. A cylinder 27 forming one portion of an hydraulic unit or capsule 28 is slidable and rotatable in each bore 15, 16. The upper end part of each cylinder 27 is domed at 29 and is engageable by the flange of a wagon wheel W when rolling along the rail 20 and over the retarder 10.

In the manner described in the specification of U.S. Pat. No. 3,637,052, but not illustrated in the accompanying drawings, each cylinder 27 is provided with a bore in which a piston is slidable, this piston being integral with or otherwise secured to a piston rod having a diameter which is small compared with that of the bore 15, 16. The piston rod engages the blind end of the respective bore and the piston divides the bore of the cylinder 27 into two chambers, the upper one of which contains hydraulic liquid up to a desired level. Beyond that level the upper chamber contains gas, for example nitrogen, which is compressed to act as a spring for effecting telescopic extension of the cylinder 27 with respect to the bores 15, 16.

Further, in the manner as also described in the above-mentioned specification, each hydraulic unit 28, formed by cylinder 27 and its piston and piston rod, is provided with valve means capable of restricting flow of liquid from one side of the piston to the other during telescopic movement of the cylinder with respect to the piston and piston rod. The gas spring provides a return force on the cylinder to tend normally to return it to a position for engagement by the periphery of a wheel rolling along the rail.

Longitudinal flanges 30, 31 of the shape shown in the accompanying drawings are formed integrally with, and project outwardly from, portions 12, 13 of retarder 10. Pairs of bearing brackets 32, 33; 34, 35 are suitably secured on the upper end faces 37, 38 of flanges 30, 31. These brackets rotatably support respective end portions of a cross-shaft 39 extending between portions 12, 13. Levers 40, 41 are mounted fast upon the shaft adjacent the ends thereof and between the respective pairs of brackets 32, 33; 34, 35.

A further pair of bearing brackets 42, 43, which are suitably secured to upstanding and integral portions 44, 45 of intermediate portion 14, rotatably support cross-shaft 39 adjacent its central portion. Mounted fast and centrally on the cross-shaft is a further lever 46 with spacer collars 47, 48 disposed between the brackets 42, 43 and that lever.

A piston-and-cylinder device 49 is also mounted upon intermediate portion 14 with its longitudinal axis 50 disposed as shown in FIG. 3. The piston 51 of device 49 is biassed to the left in FIG. 3, that is to the contracted condition of the device, by coil spring 52, and the piston rod 53 of the device is pivotally connected at 54 to the extremity of the lever 46.

Compressed air can be introduced to the chamber 55 on the left-hand side of the piston 51 as viewed in FIG. 3 by way of a connection 56 and channel 57 formed in a parallel extension casing 58 carried by the cylinder 59 of device 49. This compressed air overcomes the effort of coil spring 52 and effects extension of device 49. Thus device 49, lever 46, shaft 39 and levers 40, 41 together form holding means operable, in the manner later described, upon cylinders 27.

It is intended that a suitable number of retarders 10 are fitted in desired spaced relation to rail 20 of the railway track in a siding, the intermediate portion 14 of each retarder affording robustness and the attachment means providing rigid connection to the rail.

In operation, as for example a cut of connected wagons is being shunted into the siding, the holding means is in its inoperative condition, that is no compressed air is supplied to chambers 55 of devices 49 and thus the devices are held contracted by their coil springs 52. As each of wheels W passes over an hydraulic unit of each retarder at a speed greater than a predetermined value, wagon kinetic energy will be dissipated in the manner disclosed in the specification of the above-mentioned U.S. Pat. No. 3,637,052, wagon speed being reduced accordingly.

When, however, it is required to move the cut of connected wagons by suitable traction means out from that siding and across points onto a main line, chambers 55 of the devices 49 of all the retarders are charged with compressed air by way of their connections 56.

At this stage the cylinders 27 of all the hydraulic units 28 are in their uppermost positions as shown in full lines in the drawings, and since chambers 55 are pressurised the lever 46 of each retarder 10 is now biassed in the anti-clockwise direction in FIG. 3 by its device 49, thus urging the levers 40, 41 into mechanical engagement with the cylindrical surfaces of their adjacent cylinders 27.

As the flange of the first wheel W of the cut of connected wagons on the appropriate side of the track comes into engagement with the first cylinder 27 of the first of the retarders in its path, that flange deflects the cylinder downwardly to the position shown at 27′ in broken lines in FIG. 2 and, momentarily after, that wheel flange deflects the second cylinder 27 of that retarder downwardly to a similar position. As such positions are reached levers 40, 41 snap in the clockwise direction as viewed in FIG. 2 into engagement with the domed surfaces 29 in the manner shown in broken lines in FIG. 2 under the pressure applied to the chamber 55, which holds the levers 40, 41 in this position and thus maintains the cylinders 27 in their deflected condition.

As the following wheels of the wagons of the cut pass over that retarder, then provided their flanges are of the same or smaller diameter than those of the first wheel, those following wheels will pass over the retarder relatively quietly. However, if certain of those following wheels have flanges which are somewhat larger in diameter than the flange of said first wheel, the cylinders 27 will be deflected further downwardly as those flanges engage them. Consequently the levers 40, 41 will move further in the clockwise direction as viewed in FIG. 2 progressively to follow up this further deflection and thereby to hold the cylinders in their further deflected condition.

As the cut of connected wagons passes the other and later retarders in the siding, the leading wheel again effects the major deflection at least of the cylinders 27 of those retarders and the holding means of those retarders ensure that the cylinders are thereupon held down thus permitting the cut of connected wagons to pass out from the siding relatively quietly. By providing the holding means such movement of the wagons out from the siding can be effected even at relatively high speed without the generation of undesirable noise.

Once the cut of connected wagons is clear of all the retarder units secured to the track of the siding the compressed air in all the chambers 55 of devices 49 can be released whereupon levers 40, 41 move in an anti-clockwise direction as viewed in FIG. 2 to permit all the cylinders 27 to move upwardly to their fully-extended condition. In this way all the retarders are in readiness for effecting retardation of another cut of connected wagons subsequently entering the siding.

With reference now to the second embodiment of the invention shown in FIG. 4, the cylinder 27 of each hydraulic unit 28 can also be moved out of the path of a wagon wheel by respective actuator means 60 and can be held there by the holding means 39, 40, 41, 46, 49. Each actuator means, which in this embodiment of pneumatically-operable and of piston-and-cylinder type, includes an output member 61, the head 62 of which is engageable with the domed upper end part 29 of the respective cylinder 27. Upon contraction of the actuator means each cylinder is retracted to a position 27' shown in dotted detail, whereupon the holding means becomes operative to maintain the hydraulic unit 28 in its contracted condition. Thus, in this embodiment the cylinder 27 of the hydraulic unit may be moved to the position 27' by the wagon wheel W itself, and, alternatively, by the actuator means, and in both cases held there by the holding means. The actuator means can be suitably controlled from a position remote from the retarder to enable the cylinders 27 to be pulled down out of the path of the wheels before the wagons reach the section of the track where such retarders are installed. When operated, the actuator means can all be caused simultaneously to move the cylinders of all the retarders in the section out of the path of the wheels, or, alternatively, under particular wagon marshalling conditions, can be caused selectively to move only the cylinders of certain of the retarders out of the path of the wheels.

In FIG. 5 each of two cylinders 27 and 27' has its own holding means 49 and 49'. In this Figure components associated with cylinder 27 are identified with reference numbers identical to those in FIG. 1 while similar components associated with cylinder 27' have numerically identical reference numbers distinguished by a "prime" symbol.

The actuator means need not be pnuematically-operable but may instead be operable hydraulically, electrically, or by vacuum.

In other embodiments of the invention, where a retarder has two or, alternatively, more than two of said hydraulic units a single actuator means may instead be provided which is common to both or all of the cylinders of those units for pulling them downwardly out of the path of the wheels simultaneously or substantially so.

Although in the embodiments above described with reference to the drawings the retarder comprises an elongate retainer having two hydraulic units, in alternative embodiments of the invention the retainer may have more than two hydraulic units as suited to any particular track installation and in this case all of the cylinders of the units may have holding means either common to all of them, or alternatively the holding means may be individual to each of the hydraulic units.

Again, in alternative embodiments of the invention the retarder may have a retainer which is not of elongate form and which only houses one hydraulic unit, suitable said holding means being provided in association with a cylinder of that unit. Suitable said actuator means may also be provided in association with said cylinder.

Finally, although in the embodiments above described with reference to the drawings the device 49 is pneumatically-operable, in alternative embodiments of the invention the holding means may instead include a device which is suitably hydraulically operable, electrically operable or vacuum-operable.

We claim:

1. A retarder, suitable for reducing the speed of a wagon rolling along a railway track, including a retainer which is adapted to be secured with respect to a rail of said track, an hydraulic unit which is so fitted in said retainer that a portion thereof, which normally projects from the retainer thus to lie in the path of a wheel of said wagon so as to be engageable by that wheel, is movable inwardly of said retainer to a position out of said path in which it permits said wheel to pass said retarder, and holding means movable into engagement with said portion for maintaining said portion in that position, wherein said portion of said hydraulic unit is so movable inwardly of said retainer by said wheel as in rolling along said rail it engages said portion.

2. A retarder, suitable for reducing the speed of a wagon rolling along a railway track, including a retainer which is adapted to be secured with respect to a rail of said track, an hydraulic unit which is so fitted in said retainer that a portion thereof, which normally projects from the retainer thus to lie in the path of a wheel, is movable inwardly of said retainer to a position out of said path in which it permits said wheel to pass said retarder, and holding means for maintaining said portion in that position, said holding means being mounted on said retainer and including a lever mechanism part of which is caused mechanically to engage said portion for holding it in said position.

3. A retarder as claimed in claim 2, wherein said portion of said hydraulic unit is so movable inwardly of said retainer by said wheel as in rolling along said rail it engages said portion and is, alternatively, so movable inwardly by actuator means mechanically engageable with said portion.

4. A retarder as claimed in claim 3, wherein said actuator means is operable pneumatically.

5. A retarder as claimed in claim 2, wherein said holding means further includes fluid-pressure-operable piston-and-cylinder means which is connected to another part of said lever mechanism.

6. A retarder as claimed in claim 2, wherein said holding means is operable pneumatically.

7. A retarder as claimed in claim 2, wherein said retainer is of elongate form and said retarder includes at least two of said hydraulic units which are fitted in parallel manner in the retainer.

8. A retarder as claimed in claim 7, wherein said holding means is adapted to be common to both of said hydraulic units.

9. A retarder, suitable for reducing the speed of a wagon rolling along a railway track, including an elongate retainer comprising at least two portions, each provided with a respective bore, and an intermediate portion formed integrally with, and extending between, said two portions thus to form a single member, said retainer being adapted to be secured directly upon a rail of said track by two bolt means each of which passes through a respective hole in said rail, and at least two telescopically contractible hydraulic units, each of which is slidingly fitted in a respective said bore of said retainer so that a portion of each unit, which in the extended condition of said unit projects from the retainer thus to lie in the path of a wheel of said wagon so as to be engageable by that wheel, is telescopically movable inwardly of said bore to a position out of said path of said wheel in which it permits passage of said wheel along said rail.

10. A retarder as claimed in claim 9, wherein both of said portions of said hydraulic units, when so moved inwardly of said elongate retainer, are held in said position by holding means mounted on said retainer.

11. A retarder as claimed in claim 10, wherein said holding means includes a lever mechanism parts of which are caused mechanically to engage respective said portions of said hydraulic units for holding them in said position.

12. A retarder as claimed in claim 11, wherein said holding means further includes fluid-pressure-operable piston-and-cylinder means which are operably connected to at least one other part of said lever mechanism.

13. A retarder as claimed in claim 9, wherein said portions of said hydraulic units are so movable inwardly of said retainer by said wheel as in rolling along said rail it engages said portions and are, alternatively, so movable inwardly by actuator means mechanically engageable therewith.

14. A retarder as claimed in claim 13, wherein said holding means is operable pneumatically and is common to both said portions.

15. A retarder as claimed in claim 13, wherein said holding means is operable pneumatically, and each of said portions has its own said holding means.

* * * * *